US005957436A

United States Patent [19]

Ristau

[11] Patent Number: 5,957,436

[45] Date of Patent: Sep. 28, 1999

[54] ADJUSTABLE CHILD STAND

[76] Inventor: JoAnn Ristau, 4385 Hunting Bow Trail, Myrtle Beach, S.C. 29579

[21] Appl. No.: 08/951,266

[22] Filed: Oct. 16, 1997

[51] Int. Cl.[6] ..... E04H 17/00

[52] U.S. Cl. ..... 256/25; 256/DIG. 2; 5/99.1

[58] Field of Search ..... 256/25, 24, 26, 256/45, 1, DIG. 2; 5/98.1, 99.1, 310; 248/188.7; 135/66, 68, 77; 16/35 R

[56] References Cited

U.S. PATENT DOCUMENTS

| | | | |
|---|---|---|---|
| 156,307 | 10/1874 | Perkins . | |
| 181,743 | 8/1876 | Thompson . | |
| 955,076 | 4/1910 | Janes . | |
| 1,212,512 | 1/1917 | Kruger | 5/99.1 |
| 1,275,632 | 8/1918 | Vidrine | 5/99.1 |
| 1,278,568 | 9/1918 | Basile | 5/99.1 |
| 2,901,755 | 9/1959 | Wood, Jr. | 5/99.1 |
| 3,162,460 | 12/1964 | Davidson | 5/99.1 X |
| 3,162,865 | 12/1964 | Tigrett | 5/99.1 X |
| 3,165,760 | 1/1965 | Abajian | 5/99.1 X |
| 3,309,719 | 3/1967 | Bader et al. | 5/98.1 |
| 3,439,951 | 4/1969 | Wright . | |
| 3,886,607 | 6/1975 | Dunn | 5/99.1 X |
| 4,523,745 | 6/1985 | Killman et al. | 256/1 |
| 4,575,896 | 3/1986 | Nakao et al. | 16/35 R |
| 4,671,479 | 6/1987 | Johnson et al. | 248/188.7 X |
| 5,371,921 | 12/1994 | Roe | 16/35 R |

*Primary Examiner*—Harry C. Kim
*Attorney, Agent, or Firm*—Michael I. Kroll

[57] ABSTRACT

An adjustable child stand (10) comprising an enclosure (12) having an open top to receive and hold a child (14), so that the child (14) can stand therein. A structure (16) is for elevating in a stabilized manner the enclosure (12) off of a floor (18), so that a primary care giver (20) performing an activity, will have both hands (22) free to tend to the activity, while the child (14) within the enclosure (12) can also participate in assisting with the activity.

10 Claims, 3 Drawing Sheets

ADJUSTABLE CHILD STAND

BACKGROUND OF THE INVENTION

1. Field of the Invention

The instant invention relates generally to cribs and playpens and more specifically it relates to an adjustable child stand. The adjustable child stand will hold a child, so that a primary care giver performing an activity such as in a kitchen, will have both hands free to tend to the activity, while the child can also participate in assisting with the activity.

2. Description of the Prior Art

Numerous cribs and playpens have been provided in prior art. For example, U.S. Pat. No. 156,307 to Perkins; U.S. Pat. No. 181,743 to Thompson; U.S. Pat. No. 955,076 to Janes and U.S. Pat. No. 3,439,951 to Wright all are illustrative of such prior art. While these units may be suitable for the particular purpose to which they address, they would not be as suitable for the purposes of the present invention as heretofore described.

PERKINS, JOSHUA

IMPROVEMENT IN SAFETY FRAMES FOR CHILDREN

U.S. Pat. No. 156,307

This invention has relation to means whereby creeping children are prevented from straying and falling out of doors and down stairs. The nature of the invention consists in hinged hasps, rigidly secured to the upper and lower horizontal rails of an open folding cage, at the edge of one of the free sides thereof. A perforation in their ends is adapted to receive a pin in a corresponding position on the upper and lower rails of the second free side. The cage is prevented from opening and releasing the child when a crescent-shaped rotating catch has been turned over the end of the hasp, thereby preventing its disengagement from the pin.

THOMPSON, WILLIAM H.

IMPROVEMENT IN NURSERY CRIBS

U.S. Pat. No. 181,743

A crib having two sides hinged to a bottom. Two sides are hinged to corner posts and two divisions are hinged together.

JANES, HENRY

FOLDING CRIB AND PLAYPEN

U.S. Pat. No. 955,076

In a crib, a bed portion comprising a rectangular frame twice as long as wide and adapted to fold in two parts end downward. Legs are adapted to fold under and against the frame, whereby the bed portion may be folded square. Six individually detachable crib sections are supported on the bed portion. Each of the sections being approximately of the outline of the bed portion in its square folded position. A means is for detachably securing the sections together and to the bed portion when the latter is in an open position.

WRIGHT, REGINALD E.

CONVERTIBLE FURNITURE

U.S. Pat. No. 3,439,951

Two or more chairs are fastened together to form a cot or other article of furniture. The furniture can readily be reconverted to chairs as desired.

SUMMARY OF THE INVENTION

A primary object of the present invention is to provide an adjustable child stand that will overcome the shortcomings of the prior art devices.

Another object is to provide an adjustable child stand which will hold a child, so that a primary care giver performing an activity in a kitchen will have both hands free to tend to the activity, while the child can also participate in assisting with the activity.

An additional object is to provide an adjustable child stand that would be useful in increasing a young child's exposure to hands-on activities, lending to developmental growth of the child.

A further object is to provide an adjustable child stand that is simple and easy to use.

A still further object is to provide an adjustable child stand that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 2:
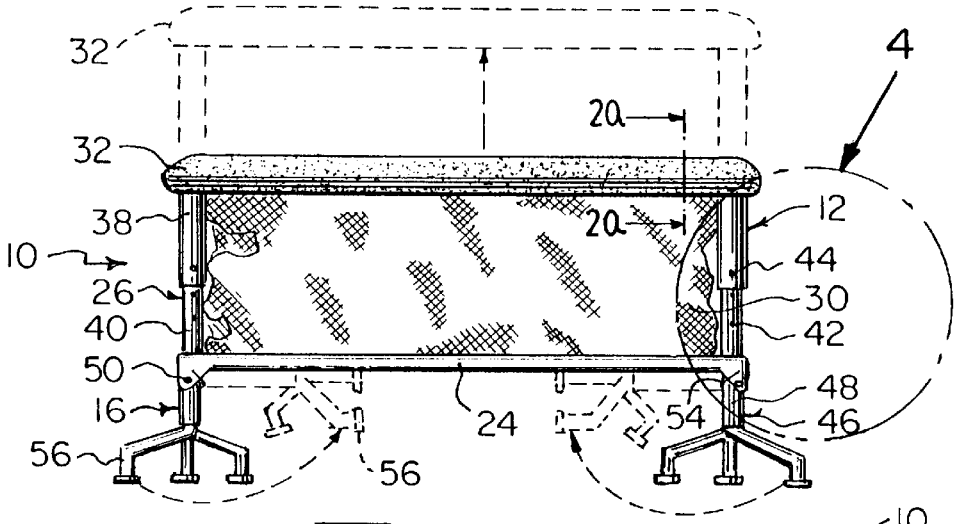
FIG. 2 is a front elevational view of the instant invention per se taken in the direction of arrow 2 in FIG. 1, shown in a collapsed position.
Figure 2A:
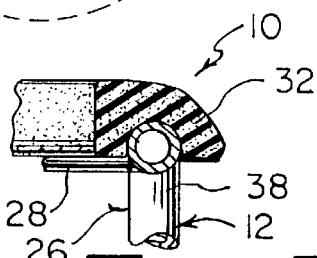

FIG. 2*a* is a cross sectional view taken along line 2*a*–2*a* in FIG. 2.

Figure 1:
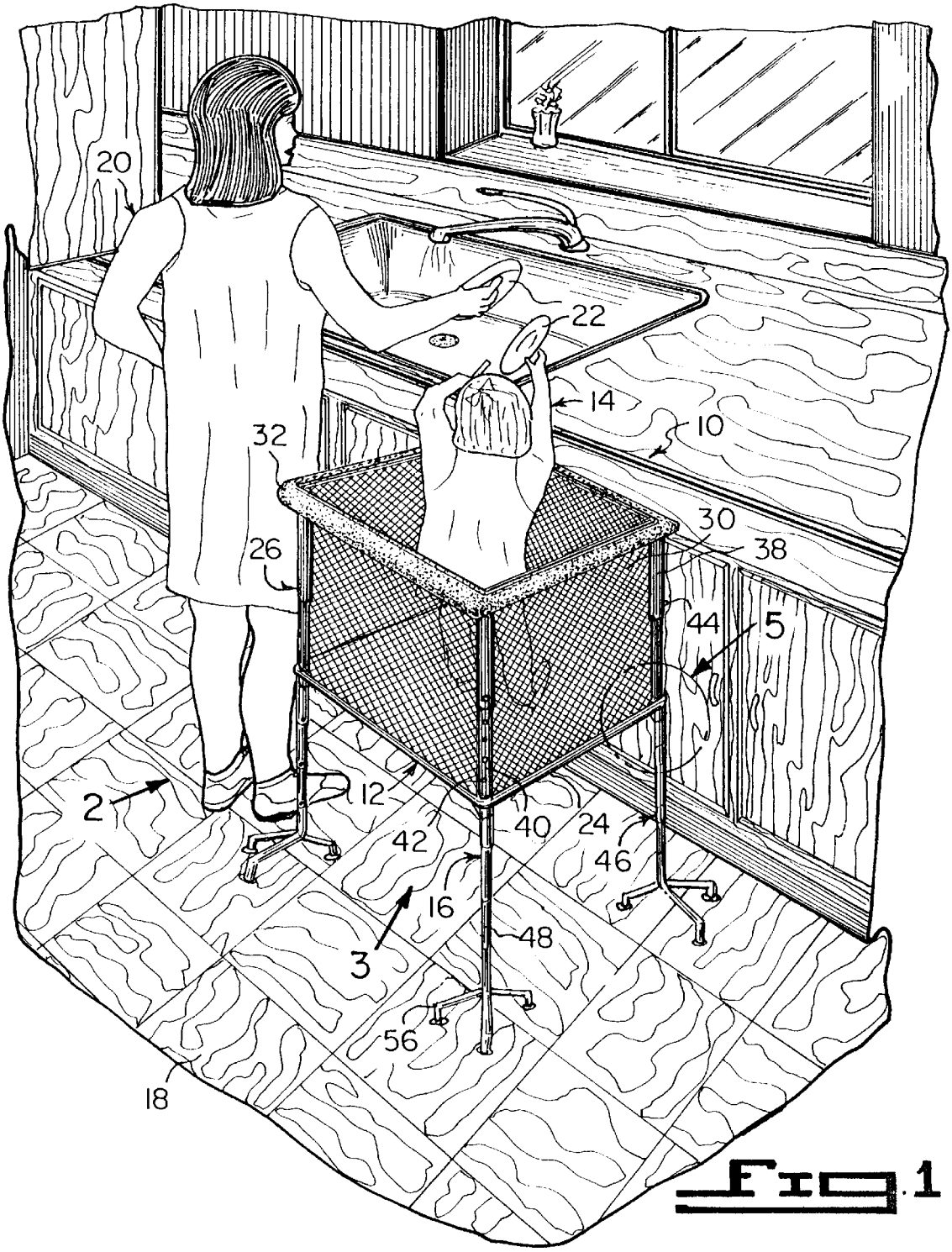
FIG. 1 is a top perspective view showing the instant invention in use.
Figure 3:
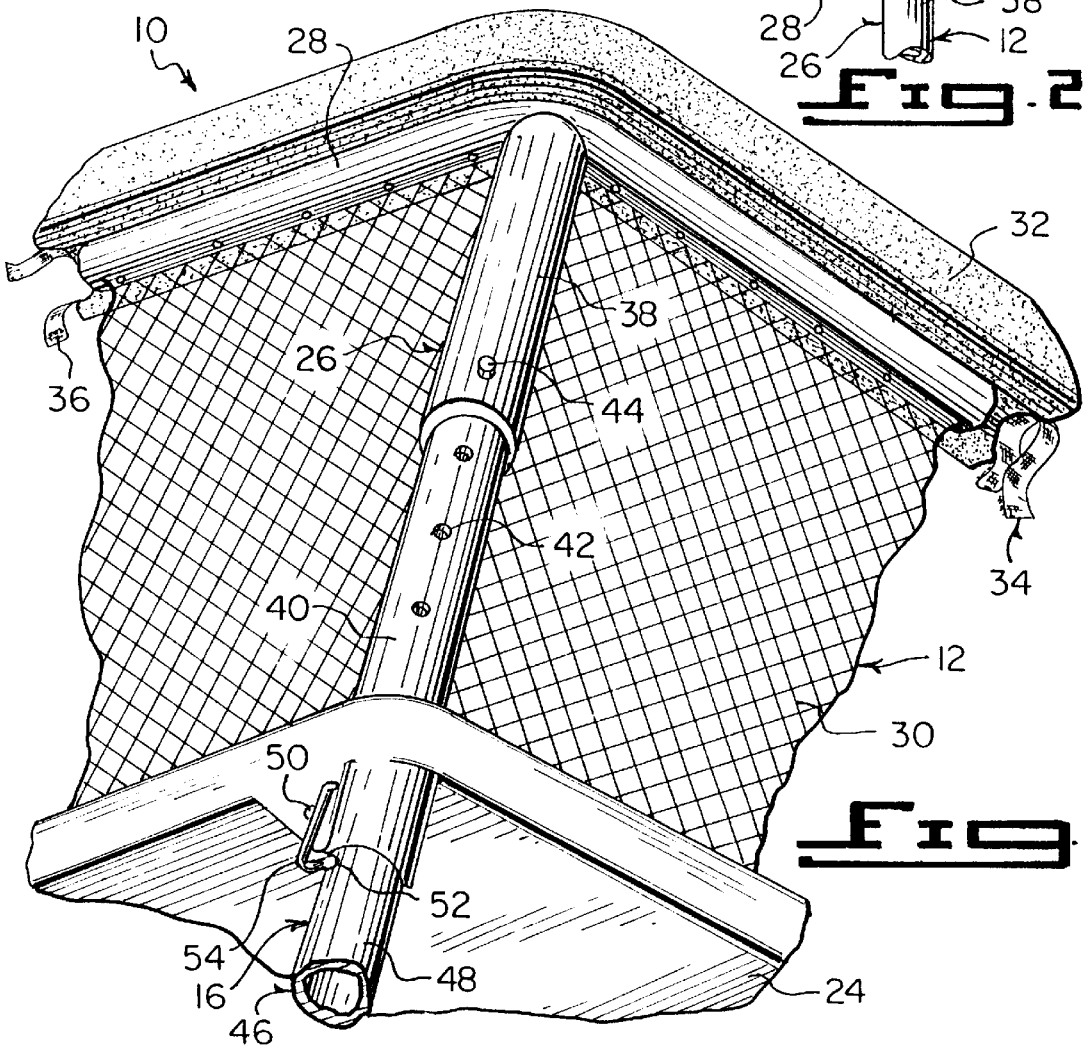

FIG. 3 is a partial bottom perspective view of the instant invention per se, taken in the direction of arrow 3 in FIG. 1.

Figure 4:
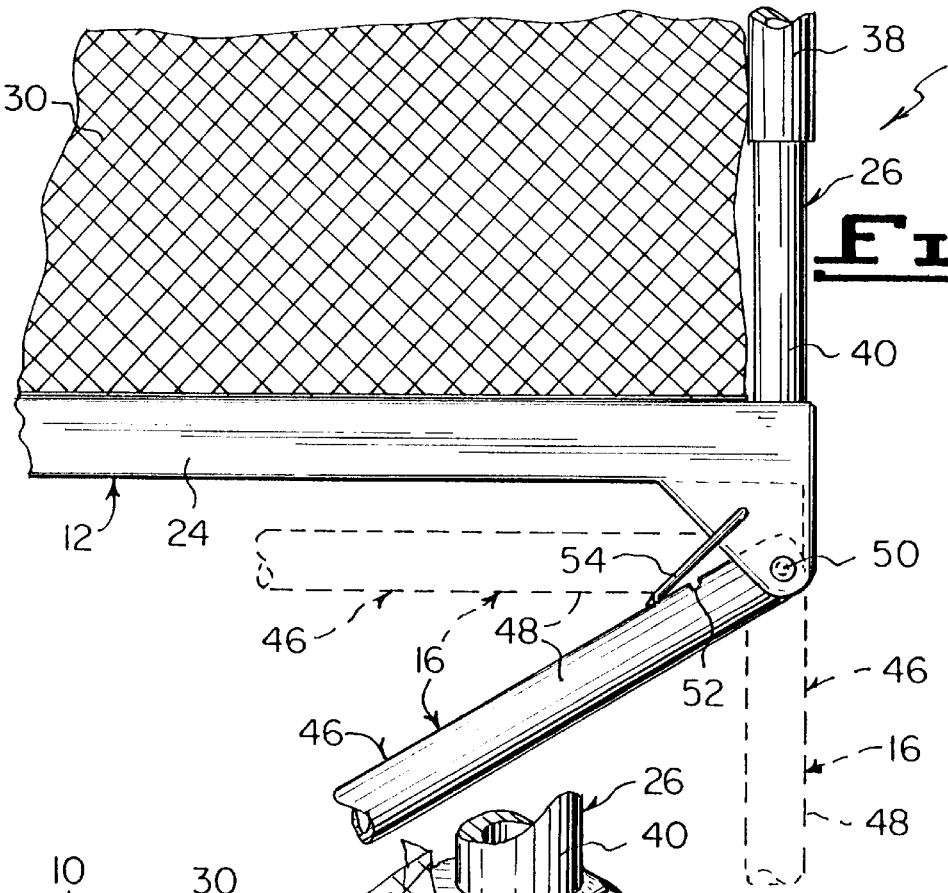

FIG. 4 is an enlarged front elevational view of area in FIG. 2, as indicated by arrow 4.

Figure 5:
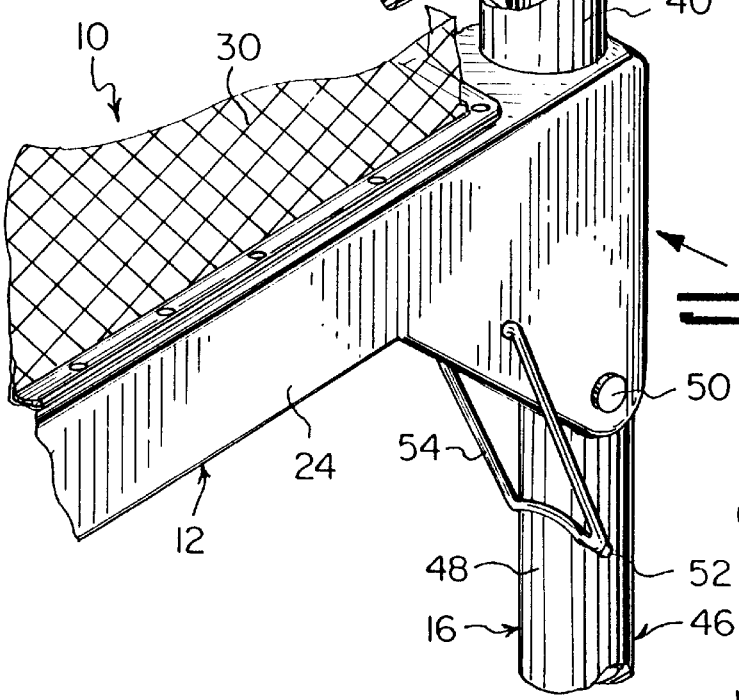

FIG. 5 is an enlarged top perspective view of an area in FIG. 1, as indicated by arrow 5.

Figure 6:
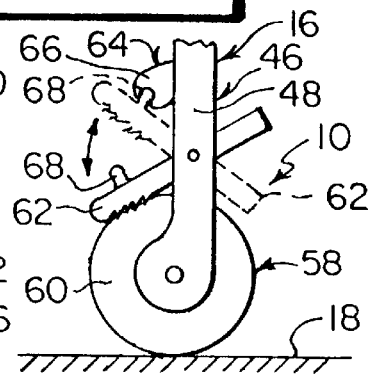

FIG. 6 is an elevational view showing a lockable wheel for one of the tripod feet.

Similar reference characters denote corresponding features consistently throughout the attached drawings.

DESCRIPTION OF THE PREFERRED EMBODIMENTS

Turning now descriptively to the drawings, in which similar reference characters denote similar elements throughout the several views, FIGS. 1 through 6 illustrate the present invention being an adjustable child stand 10. With regard to the reference numerals used, the following numbering is used throughout the various drawing figures.

10 adjustable child stand
12 enclosure of 10
14 child in 12

16 elevating structure of 10
18 floor
20 primary care giver
22 hand of 20
24 platform of 12
26 corner post of 12
28 top rail of 12
30 mesh net of 12
32 padded cushion of 12
34 attaching facility of 12
36 VELCRO strap for 34
38 upper segment of 26
40 lower segment of 26
42 hole in 40
44 spring biased locking pin button of 26
46 leg of 16
48 interlocking portion of 46
50 pivot pin of 46
52 notch on 46
54 spring biased retainer clip on 24
56 tripod foot on 46
58 lockable wheel assembly on 46
60 wheel of 58
62 spring biased brake lever of 58
64 snap fastener of 58
66 socket of 64 on 46
68 ball of 64 on 62

The adjustable child stand 10 comprises an enclosure 12 having an open top to receive and hold a child 14, so that the child 14 can stand therein. A structure 16 is for elevating in a stabilized manner the enclosure 12 off of a floor 18, so that a primary care give 20 performing an activity, will have both hands 22 free to tend to the activity, while the child 14 within the enclosure 12 can also participate in assisting with the activity. The activity can be washing dishes at a sink in a kitchen, as shown in FIG. 1.

The enclosure 12 includes a platform 24, with four corner posts 26 extending upwardly from the platform 24. A top rail 28 is affixed to upper ends of the four corner posts 26. A mesh net 30 is affixed to the perimeter of the platform 24 and to the top rail 28.

The enclosure 12 further includes a padded cushion 32. A facility 34 is for attaching the padded cushion 32 to the top rail 28, so as to protect the child 14 when placed within the enclosure 12. The attaching facility 34 consists of a plurality of VELCRO straps 36 affixed to the padded cushion 32. Each VELCRO strap 36 is wrapped about and seured to the top rail 28.

Each corner post 26 is telescopic, so that the top rail 28 can be height adjusted with respect to the platform 24, to meet the needs of a growing child 14. Each corner post 26 includes an upper segment 38 attached to the top rail 28. A lower segment 40 has a plurality of spaced apart holes 42 therein. The lower segment 40 slides within the upper segment 38. A spring biased locking pin button 44 is in the upper segment 38, which can engage with any one of the holes 42 in the lower segment 40.

The elevating structure 16 contains four legs 46. Each leg 46 extends downwardly from one corner of the platform 24. Each leg 46 is collapsible for easy storage.

Each leg 46 includes a plurality of interlocking portions 48 that fit into each other. Each leg 46 is pivotally attached with a pivot pin 50 at an upper end to one corner of the platform 24, so that the legs 46 can fold up under the platform 24 for storage when not in use.

Each leg 46 has an inwardly facing notch 52 adjacent to the pivot pin 50. A spring biased retainer clip 54 is hinged to the platform 24 adjacent to one notch 52. When the legs 46 are unfolded, the retainer clips 54 will engage with the notches 52 to keep the legs 46 in a vertical position.

Each leg 46, as shown in FIGS. 1 and 2, can include a tripod foot 56 to further stabilize the leg 46 upon the floor 18 and prevent the child 14 from tipping the enclosure 12 over, if the child 14 leans over the top rail 28. Each leg 46, as shown in FIG. 6, can include a lockable wheel assembly 58, to allow for easy movement from place to place along the floor 18 when unlocked, and retained in place when locked.

Each lockable wheel assembly 58 consists of a wheel 60 rotatively carried on a bottom end of the leg 46. A spring biased brake lever 62 is pivotally carried on the leg 46 above the wheel 60. The brake lever 62 will normally engage with the wheel 60, to prevent the wheel 60 from rotating upon the floor 18. A snap fastener 64 has a socket 66 on the leg 46 and a ball 68 on the brake lever 62. When the brake lever 62 is manually disengaged from the wheel 60, the ball 68 will mate with the socket 66 to hold the brake lever 62 away from the wheel 60, to allow for easy movement thereof along the floor 18.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An adjustable child stand comprising:

a) an enclosure having an open top to receive and hold a child, so that the child can stand therein, a platform, four corner posts extending upwardly from said platform, a top rail affixed to upper ends of said four corner posts, and a mesh net affixed to the perimeter of said platform and to said top rail; and b) means for elevating in a stabilized manner said enclosure off of a floor including four legs; each leg extending downwardly from one corner of said platform and collapsible for easy storage, each said leg being pivotally attached with a pivot pin at an upperend to one corner of said platform so that said legs can fold up under said platform for storage when not in use, each said leg having an inwardly facing notch adjacent to said pivot pin and a sipring biased retainer clip hinged to said platform adjacent to said notch, so that when said legs are unfolded said retainer clips will engage with said notches to keep said legs in a vertical position, so that a primary care giver performing an activity, will have both hands free to tend to the activity, while the child within said enclosure can also participate in assisting with the activity.

2. An adjustable child stand as recited in claim 1, wherein said enclosure further includes:

a) a padded cushion; and b) means for attaching said padded cushion to said top rail, so as to protect the child when placed within said enclosure.

3. An adjustable child stand as recited in claim 2, wherein said attaching means includes a plurality of hook and loop fastener straps affixed to said padded cushion, whereby each said fastener strap is wrapped about and secured to said top rail.

4. An adjustable child stand as recited in claim 1, wherein each said leg includes a tripod foot to further stabilize said leg upon the floor and prevent the child from tipping said enclosure over if the child leans over said top rail.

5. An adjustable child stand as recited in claim 1, wherein each said leg includes a lockable wheel assembly to allow for easy movement from place to place along the floor when unlocked, and retained in place when locked.

6. An adjustable child stand comprising:

a) an enclosure having an open top to receive and hold a child, so that the child can stand therein, wherein said enclosure includes a platform, four corner posts extending upwardly from said platform, a top rail affixed to upper ends of said four corner posts and a mesh net affixed to the perimeter of said platform and to said top rail;

b) means for elevating in a stabilized manner said enclosure off of a floor comprising four legs, whereby each said leg extends downwardly from one corner of said platform, each leg being collapsible and includes a plurality of interlocking portions that fit into each other so that a primary care giver performing an activity, will have both hands free to tend to the activity, while the child within said enclosure can also participate in assisting with the activity;

c) said enclosure further including aadded cushion and means for attaching said Dadded cushion to said top rail, so as to protect the child when placed within said enclosure, said attaching means including a plurality of loop and hook fastener straps affixed to said padded cushion and wrapped about and secured to said top rail;

d) each said corner post being telescopic, so that said top rail can be height adjusted with respect to said platform to meet the needs of a growing child, and each corner post including an upper segment attached to said top rail, a lower segment having a plurality of spaced apart holes therein, whereby said lower segment slides within said upper segment, and a spring biased locking pin button in said upper segment, which can engage with any one of said holes in said lower segment; and e) each leg is pivotally attached with a pivot pin at an upper end to one corner of said platform, so that said legs can fold up under said platform for storage when not in use, each leg having an inwardly facing notch adjacent to said pivot pin and a spring biased retainer clip hinged to said platform adjacent to one said notch, so that when said legs are unfolded said retainer clips will engage with said notches to keep said legs in a vertical position.

7. An adjustable child stand as recited in claim 6, wherein each said leg includes a tripod foot to further stabilize said leg upon the floor and prevent the child from tipping said enclosure over if the child leans over said top rail.

8. An adjustable child stand as recited in claim 6, wherein each said leg includes a lockable wheel assembly to allow for easy movement from place to place along the floor when unlocked, and retained in place when locked.

9. An adjustable child stand as recited in claim 6, wherein each said lockable wheel assembly includes:

a) a wheel rotatively carried on a bottom end of said leg;

b) a spring biased brake lever pivotally carried on said leg above said wheel, whereby said brake lever will normally engage with said wheel to prevent said wheel from rotating upon the floor; and c) a snap fastener having a socket on said leg and a ball on said brake lever, so that when said brake lever is manually disengaged from said wheel, said ball will mate with said socket to hold said brake lever away from said wheel, to allow for easy movement thereof along the floor.

10. An adjustable child stand comprising:

a) an enclosure having an open top to receive and hold a child, so that the child can stand therein, a platform, four corner posts extending upwardly from said platform, a top rail affixed to upper ends of said four corner posts, and a mesh net affixed to the perimeter of said platform and to said top rail; and b) means for elevating in a stabilized manner said enclosure off of a floor including four legs, each leg extending downwardly from one corner of said platform and including a lockable wheel assembly to allow for easy movement from place to place along the floor when unlocked and retained in place when locked, each wheel assembly including a wheel rotatively carried on a bottom end of said leg, a spring biased brake lever pivotally carried on said leg above said wheel, whereby said brake lever will normally engage with said wheel to prevent said wheel from rotating upon the floor, and a snap fastener having a socket on said leg and a ball on said brake lever so that when said brake lever is manually disengaged from said wheel said ball will mate with said socket to hold said brake lever away from said wheel to allow for easy movement thereof along the floor, permitting a primary care giver performing an activity, to have both hands free to tend to the activity, while the child within said enclosure can also participate in assisting with the activity.

* * * * *